United States Patent [19]

Sciara

[11] Patent Number: 4,860,747

[45] Date of Patent: Aug. 29, 1989

[54] EAR PIERCING APPARATUS

[75] Inventor: Anthony Sciara, Oakville, Canada

[73] Assignee: First Lady Coiffures Ltd., Toronto, Canada

[21] Appl. No.: 136,042

[22] Filed: Dec. 21, 1987

[51] Int. Cl.[4] ..... A61B 17/00

[52] U.S. Cl. ..... 128/330

[58] Field of Search ..... 128/330, 329 R, 314, 128/315

[56] References Cited

U.S. PATENT DOCUMENTS

| | | | |
|---|---|---|---|
| 2,570,048 | 10/1951 | Cooke et al. | 128/330 |
| 2,798,491 | 7/1957 | Samuels . | |
| 3,187,751 | 6/1965 | Coren et al. | 128/330 |
| 3,941,134 | 3/1976 | McDonald | 128/330 |
| 3,943,935 | 3/1976 | Cameron | 128/330 |
| 4,009,718 | 3/1977 | Hastings | 128/330 |
| 4,020,848 | 5/1977 | DiCicco | 128/330 |
| 4,030,507 | 6/1977 | Mann | 128/330 |
| 4,068,668 | 1/1978 | Moore et al. | 128/330 |
| 4,079,740 | 3/1978 | Phalon | 128/330 |
| 4,146,032 | 3/1979 | Rubenstein et al. . | |
| 4,527,563 | 7/1985 | Reil | 128/330 |

FOREIGN PATENT DOCUMENTS

| | | |
|---|---|---|
| 2597 | of 1903 | United Kingdom . |
| 1515692 | 6/1978 | United Kingdom . |

*Primary Examiner*—John D. Yasko

[57] ABSTRACT

An ear piercing apparatus has an instrument with jaws movable towards one another. A plunger is provided for driving a stud through an ear into a clasp. To aid sterility, the stud is mounted in a disposable stud holder on one jaw and the clasp is mounted in a disposable clasp holder on the other jaw. A protective cover is integral with one of the holders, extends between the jaws and covers a portion of an arm between the jaws.

26 Claims, 3 Drawing Sheets

FIG. 4
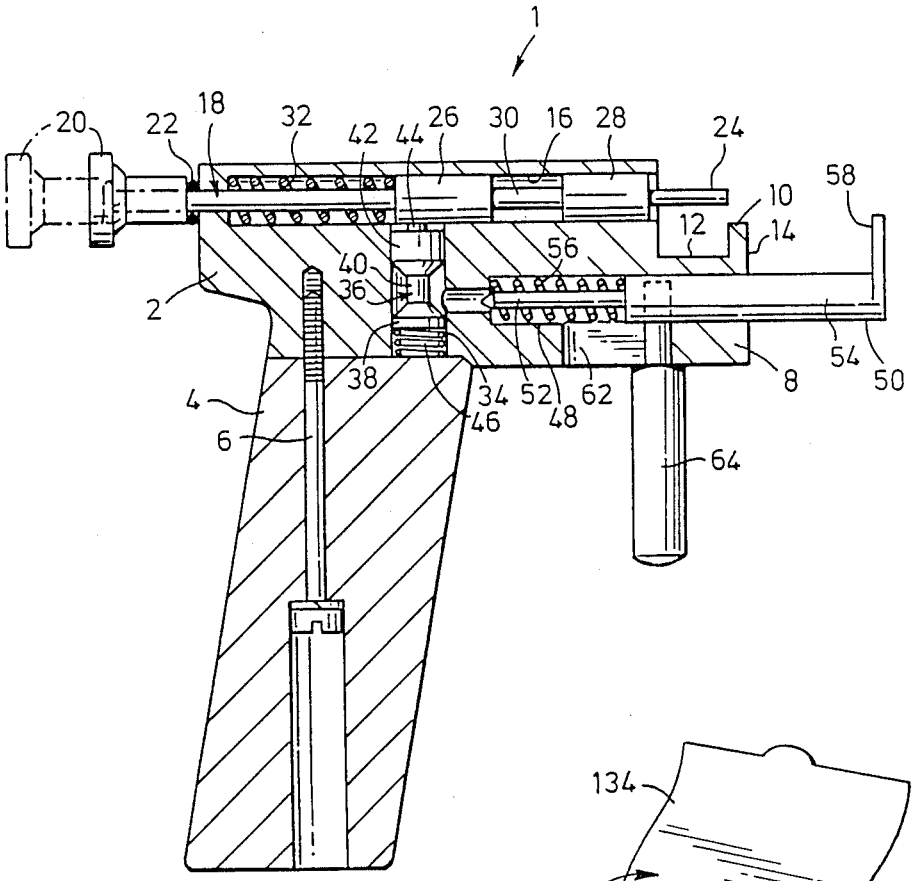
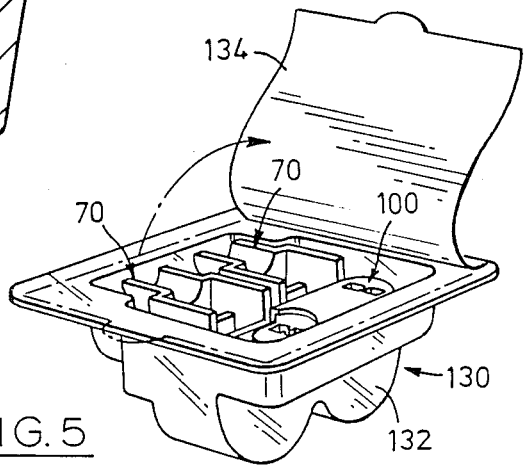
FIG. 5

EAR PIERCING APPARATUS

FIELD OF THE INVENTION

This invention relates to an apparatus for piercing ears.

BACKGROUND OF THE INVENTION

Presently, many women and some men wish to have their ears pierced, so that they can wear a variety of earrings or other ear ornaments. For this purpose, there have been proposed a variety of different devices and techniques, intended to facilitate ear piercing.

One relatively early proposal can be found in the DiCicco U.S. Pat. No. 4,020,848. This discloses an apparatus for piercing earlobes. It has first and second jaws adapted to receive the mating portions of the ear ornament, usually a stud and clasp. Additionally, a positioning plate is provided, so that an earlobe can be held between this positioning plate and another positioning plate carried by the second jaw. The apparatus requires two separate actions. First, a closure trigger is pulled, to move the second jaw, to hold the earlobe between the positioning plates. Then, a separate trigger has to be actuated to release the spring-loaded first jaw. Part of the ornament is held in the first jaw and this is then driven through the ear to pierce it. Thus, two separate actions are required, making this a reatively cumbersome and inconvenient device.

The DiCicco apparatus is now being superseded by single action devices, which require just one trigger to be pulled to complete the entire ear-piercing operation.

The Mann U.S. Pat. No. 4,030,507 discloses a sterile earlobe-piercing assembly. Here, a relatively complex arrangement is provided for mounting the stud or piercing earring. The piercing earring is mounted in a cartridge having an elongate opening supporting the pin and an aligned second opening. The cartridge is in turn mounted in a cartridge housing. A plunger can displace the cartridge within the housing and then eject the earring from the cartridge. A wire nut assembly is provided holding the wire nuts or clasps for two earrings. The wire nuts are held in blind bores in a wire nut cartridge, which is mounted in the device. The overall configuration of the various cartridges and cartridge housing is quite complex.

In U.S. Pat. No. 4,068,668 there is disclosed an earlobe piercing device including a means for holding an earlobe to numb the earlobe prior to insertion of a stud. The stud and clasp are held directly in the device.

In U.S. Pat. No. 4,079,740 there is disclosed an ear piercing system using a gun-like instrument. Here, the stud and clasp are again held in cartridges. However, the cartridges do not ensure that the gun itself does not contact the person's earlobe, to ensure sterile operation. In fact, the drawings suggest that the earlobe is contacted on both sides by the actual jaws themselves.

The Rubenstein patent discloses an ear piercing device in which an earlobe is held between a pair of positioning guides. Again, the problem of the sterile mounting of the stud and clasp, and an overall sterile technique are not discussed.

A relatively complex sterile earlobe piercing assembly is disclosed in the Reil U.S. Pat. No. 4,527,563. Here, a gun-type instrument is again used. This requires three disposable components, namely a stud holder, an alignment member and a clasp carrying member. Even so it is believed that it will not guarantee that the earlobe only contacts the sterile disposably components; the earlobe may contact parts of the main gun or instrument assembly.

Two relatively recent published United Kingdom patent application Nos. 2,142,538A and 2,149,305A both name W. J. Gardner as the inventor and relate to improvements in ear piercing apparatus. Here, the back clasps are held in a disposable insert. Each stud is located in a disposable cassette. In the earlier application, the stud cassette is mounted on one jaw, and the stud is driven out of it by a plunger. In the later application, the stud is actually mounted in the end of the plunger.

It is to be realized that with modern ear piercing equipment, ear piercing is a relatively, quick, simple and painless operation. As such, it does not require the presence of highly qualified medical personnel and is routinely carried out in jewellery and department stores. The operator of the ear piercing equipment frequently does not ensure that it is properly cleaned between customers.

As a consequence, there is the risk of infection being transferred by the gun or instrument itself. It has been known for women who have had their ears pierced to contract hepatitis or other diseases carried by the blood. It only requires a microscopic quantity of blood to be carried by the instrument from one customer to the next. This situation has prompted government agencies in some countries to pass laws to protect customers, with a view to protecting them from contracting such diseases.

As detailed above, whilst there are earlier proposals which address this problem, many of them have various drawbacks. Thus, many of them are relatively complex, and the disposable, sterile components for holding the stud and clasp are quite complex. They would thus be quite expensive, which would be a deterrent to their common use. Further, a common failing with many earlier proposals is that they do not fully ensure that the patients earlobe does not contact the gun or instrument itself.

What is desired is an ear piercing apparatus, in which the ear-piercing gun and disposable elements holding the stud and clasp ensure that the person's earlobe or face cannot contact the gun. The person's earlobe should only contact the stud and clasp and the disposable elements holding them. Then, even if significant quantities of blood etc. are carried by the gun, since there is no direct contact with the patient's earlobe, the risk of infection should be minimal.

Further, the disposable elements holding the stud and clasp should be configured so that they can be easily manipulated by the operator and mounted on the gun with little or no risk of the operator contaminating the stud or clasp.

SUMMARY OF THE PRESENT INVENTION

In accordance with one embodiment of the present invention, there is provided an ear piercing apparatus comprising: an instrument comprising a body including a handle, a first, fixed jaw on the body, an arm movably mounted in the body and extending in alignment with the first jaw, a second jaw secured to the arm, a plunger slidably mounted in the body and aligned with the first and second jaws and actuating means for driving the plunger towards the second jaw; a disposable stud holder and a stud mounted within the stud holder, with the stud holder mounted on the first jaw and; a disposable clasp holder and a clasp mounted in the clasp holder, with the clasp holder mounted on the second jaw; and a protective cover member integral with one holder and extending from the first jaw towards the second jaw and covering a portion of the arm.

The arrangement of the stud and clasp holders, with the protective cover member as part of one of them should ensure that no portion of a person's ear comes into direct contact with the instrument itself. Thus, the protective cover member preferably has a length corresponding to the typical earlobe thickness and is part of the stud holder. In use, stud and clasp holders are mounted on the instrument. The first jaw can then be brought up against a person's earlobe, so that the stud holder abuts the outer face of the earlobe and the protective cover member extends underneath it. The instrument is then operated to bring the second jaw up against the other side of the earlobe. The lower part of the earlobe is then bounded by the stud holder including its protective cover member and the clasp holder; no part of the instrument contacts the earlobe. The plunger can then be actuated to drive a stud through the earlobe into the clasp. The instrument is then released and the jaws move apart releasing the earlobe. The instrument can then be removed, without any part of the instrument itself having direct contact with the person.

To further ensure no contact between the instrument and hence sterility, the clasp holder on the movable second jaw can be shaped as to cover an outer face of the second jaw. With the jaws open, when the instrument is brought up against a person's earlobe, the second jaw and clasp holder can abut or brush against the side of the person's face. Accordingly, it is desirable that here again no part of the instrument makes direct contact, in case that part of the instrument has been contaminated from previous usage. By covering this with the clasp holder, sterility and hygiene should be greatly increased. The disposable clasp holder is sterile.

Further, whilst for simplicity only the stud holder has a protective cover member the clasp holder could as well or alternatively be provided with a cover member. These could be spaced vertically, so that they overlap one another when the jaws are moved towards one another.

The present invention also provides an assembly for use with an ear piercing instrument comprising a body including a handle, a first, fixed jaw on the body, an arm movably mounted in the body and extending in alignment with the first jaw, a second jaw secured to the arm, a plunger aligned with the first and second jaws and slidably mounted in the body, and actuating means for driving the plunger towards the second jaw, the assembly comprising a pair of disposable stud holders, each of which includes means for mounting the stud holder on the first jaw of such an instrument; a pair of studs, each mounted in a respective stud holder; a clasp holder means including means for mounting the clasp holder means on the second jaw; a pair of clasps mounted in the clasp holder means; and protective cover members for covering a portion of the arm.

Preferably, the assembly of stud and clasp holders defined above is mounted in a package comprising a container and a closure member, with the stud and clasp holders mounted in the container facing the closure member. Then, when the closure member is removed, the jaws of the instrument can be engaged with the stud and clasp holders without the operator having to manipulate or otherwise touch the holders. More preferably, the container is a transparent plastic container shaped to conform to the stud and clasp holders, of a type known as a "blister pack". The closure member would then be a sheet of paper, cardboard or the like bonded to the plastic container.

BRIEF DESCRIPTION OF THE DRAWINGS

For better understanding of the present invention, and to show more clearly how it may be carried into effect, reference will now be made, by way of example, to the accompanying drawings, in which:

FIG. 4 shows a vertical sectional view of the instrument of FIGS. 1, 2 and 3; and FIG. 5 is a perspective view of a blister pack.

DESCRIPTION OF THE PREFERRED EMBODIMENT

Figure 1:
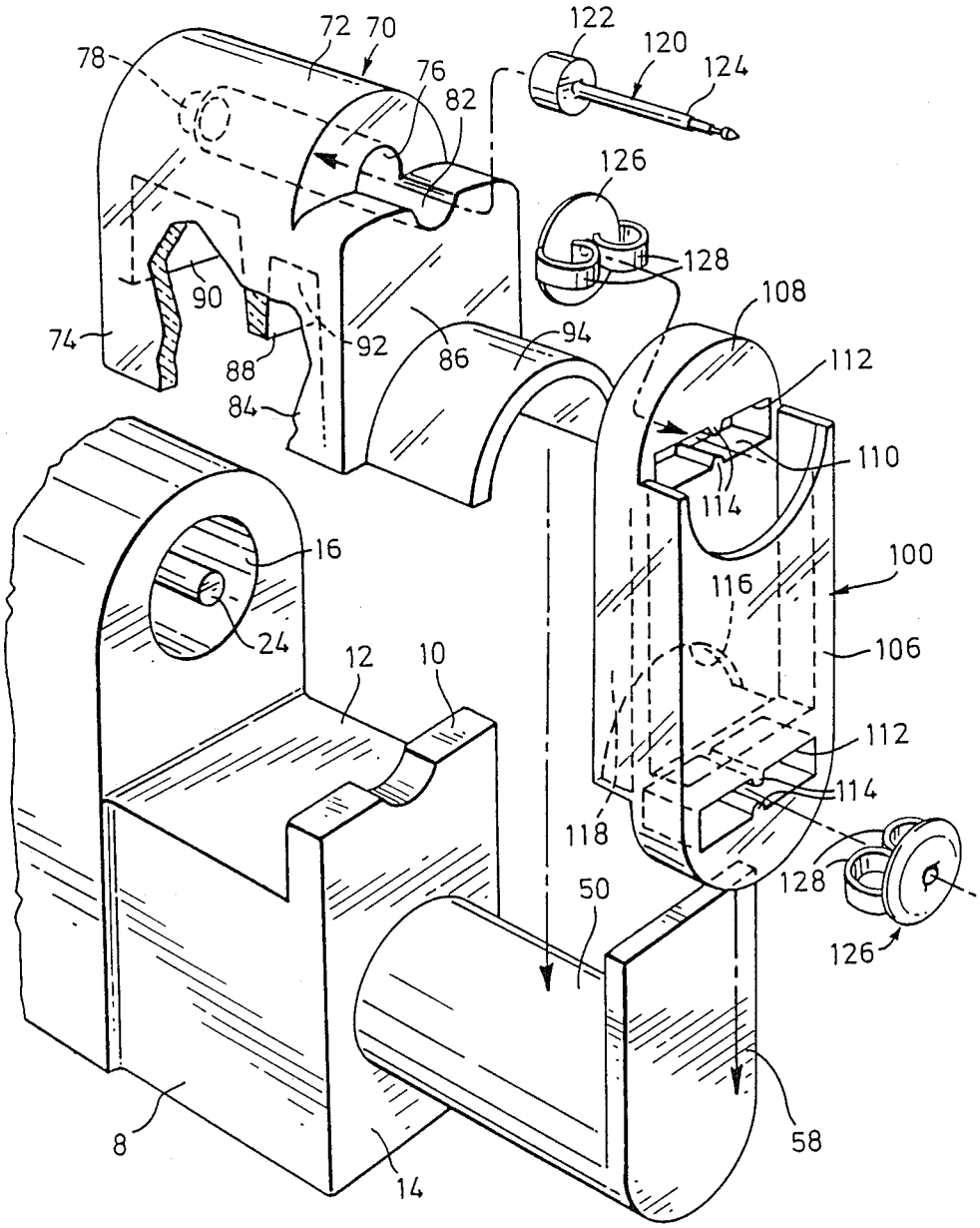
FIG. 1 shows a perspective, exploded view of stud and clasp holders and part of an ear piercing instrument, in accordance with the present invention.
Figure 2:
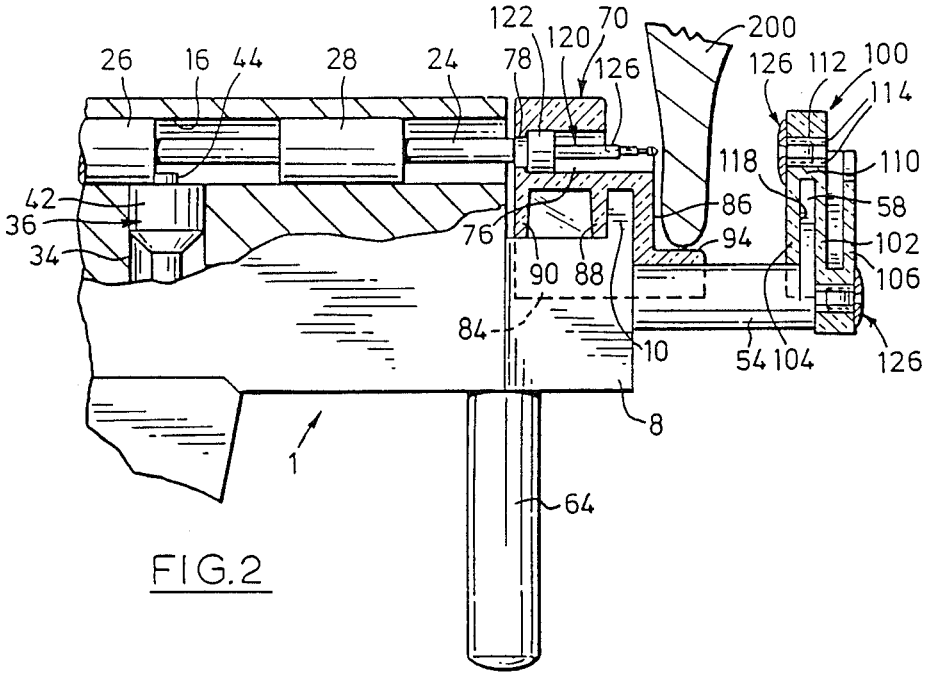
FIG. 2 shows a side view, in partial section, of the instrument and stud and clasp holder of FIG. 1, prior to operation.
Figure 3:
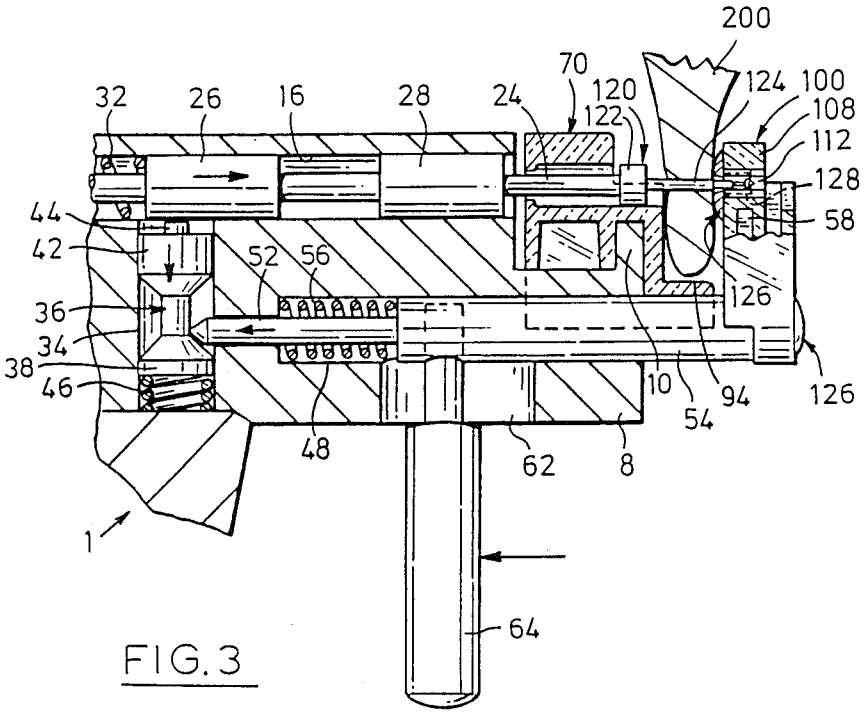
FIG. 3 shows a side view, in partial section, similar to FIG. 2, after operation.

In the drawings, an ear piercing instrument forming part of the apparatus of the present invention is generally demoted by the reference 1. This ear piercing instrument 1 is of a gun or pistol-type. It is largely conventional, and accordingly its construction is only described in outline, mainly with reference to FIG. 4.

The ear piercing instrument 1 has a body 2. Attached to the body 2 is a handle 4, the handle 4 being attached by a screw 6. The body 2 and handle 4 are formed as separate components, but conceivably could be formed as one component, with minor alternations to other parts of the instrument.

The body 2 includes a first jaw 8. The first jaw 8 has a generally rectangular projection 10, including a slight circular recess at the top thereof, to permit passage of the heads of studs, as described below. Additionally, the first jaw 8 has a planar top surface 12 and a front face 14.

Within the body 2, there is a plunger bore 16, which is generally cylindrical and extends from one end of the body to the other, in alignment with the first jaw 8. A plunger 18 comprises an elongate shaft, one end of which is threaded and has a knob 20 screwed onto it. An "O" ring 22 is provided as a cushioning or damping member between the knob 20 and the body 2. The other end 24 of the plunger 18 is of reduced diameter, and forms a driving end. The plunger 18 includes two portions 26, 28 of relatively large diameter and such as to form a sliding fit within the bore 16. Between these portions 26, 28, there is a portion 30 of reduced diameter. The end of the bore 16 adjacent to the knob 20 has a reduced diameter, as compared to the rest of the bore 16, and a compression spring 32 acts between the body 2 and the portion 26 of relatively large diameter.

A vertical bore 34 extends down through the body 2 from the plunger bore 16 to the handle 4. Within this vertical bore 34, there is a locking member 36. Locking member 36 has a lower end portion 38, a central, waist portion 40 and an upper end portion 42, with the end portions 38, 42 having conical faces that merge with the central, waist portion 40. The upper end portion 42 has a circular protrusion 44 at its centre, for engaging the portion 26 of large diameter. A short compression spring 46 acts between the locking member 36 and the handle 4.

An additional bore 48 extends from the front face 14 of the jaw 8 to the vertical bore 34, with its end at the vertical bore 34 having a relatively small diameter so as to form an annular step. An arm 50 of generally circular section includes an inner, end part 52 of relatively small diameter and a main part 54 of large diameter. A compression spring 56 acts between the main part 54 and the body 2. A second jaw 58 extends upwards from the end of the main part 54. This jaw 58 is generally rectangular and includes a part circular recess 60.

A slot 62 extends through the body to the additional bore 48, and an operating lever 64, which is generally circular extends through the slot 62 and is secured to the arm 50, so that the lever 64 and arm 50 are capable of sliding movement in the body 2.

Now, in accordance with the present invention, for mounting the stud and clasp, there are provided stud and clasp holders.

Considering first the stud holder, this is designated by the reference 70. The stud holder 70 includes a generally solid semi-circular top part 72 located above a main part 74. A bore 76 extends horizontally for receiving a head of a stud. A rear opening 78 to the bore 76 is of smaller diameter and is joined to the main part of the bore by a frustro-conical portion. A front, upper surface of the main part 74 is rounded at the edges and includes a semi-circular recess 82.

The main part 74 includes side walls 84 and a front wall 86. Extending between the side walls 84 are a front transverse flange 88 and a rear transverse flange 90. The flanges 88, 90 are intended to abut the planar top surface 12 of the body 2 of the instrument 1. A slot 92 is defined between the front flange 88 and the front wall 86, for receiving the rectangular projection 10 of the first jaw 8.

In accordance with the present invention, a protective cover member 94 extends forwardly from the front wall 86. The protective cover member 94 is generally semi-circular in shape, and its front edge is rounded, to make it more comfortable for the user. The shape of the protective member 94 conforms to the cross-section of the arm 50. The length of the protective cover member 94 is such that when the lever 64 and arm 50 are fully retracted, a clasp holder on the second jaw 58 is adjacent the protective cover member 94, so as to leave no part of the upper of the arm 50 exposed.

The clasp holder is generally designated by the reference 100. The clasp holder 100 includes a central wall 102, and it is generally symetrical about this central wall 102. First and second end walls 104, 106 are provided on either side of the central wall. A first generally semi-circular part 108 joins the walls 102, 104 together. Additionally, a first transverse web 110 extends between the wall 102, 104. A rectangular opening 112 is defined between the web 110 and the semi-circular part 108. Short protrusions of 114 of generally square section extend from the semi-circular part 108 and transverse web 110 towards one another.

The other end of the first side wall 104 terminates in a concave semi-circular edge 116 corresponding to the profile of arm 50, and a slot 118 for the second jaw 58 is defined between the walls 102, 104.

Due to the symmetry of the clasp holder 100, the elements of the other side, between the second side wall 106 and the central wall 102 are generally similar, and accordingly will not be described in detail. Like components are given the same reference numeral.

The studs and clasps used are of conventional design, and accordingly are not described in great detail. The stud is designated by the reference 120 and includes a head 122 which is generally cylindrical and a shaft 124 with a pointed end. The shaft 124 is also shaped to retain a clasp on it. The head 122 of each stud 120 is snugly received in the bore 76 of a respective stud holder 70, with the end of the head against the small rear opening 78, and the shaft 124 extending in the other direction. A clasp is designated by the reference 126, and comprising a central disc part and side legs 128. The side legs each extend through nearly a full circle. The ends of the side legs 128 are located close together, so that in use they grip the shaft 124. Similarly, when mounted in the clasp holder 100, the legs 128 grip the protrusions 114, to retain each clasp 126 in the clasp holder.

As shown in FIG. 5, the equipment necessary for a single person is packaged in a single blister pack 130. In known manner, the blister pack 130 comprises a transparent, plastic blister 132, having a planar flange, and a paper or cardboard closure sheet 134 bonded to that flange. The blister 132 is shaped to hold a pair of stud holders 70 and one clasp holder 100. As described in detail below, the stud holder 70 and clasp holder 100 are so located in the blister 132, that when the closure sheet 134 is removed they can be readily engaged with the jaws of the ear piercing instrument 1 without requiring manual removal from the blister 132.

Having described the apparatus, the mode of use of the apparatus will now be described.

First, for each ear, the front and back surfaces of the earlobe and cleansed with a suitable antiseptic lotion. The precise location for the piercing is then marked with a surgical skin marker.

A blister pack 130 is selected. Usually, the blister packs 130 will be provided with studs 120 containing different coloured ornaments or jewels. An appropriate colour would be selected. The closure sheet 134 of the blister pack 130 is removed, without touching the contents.

The piercing instrument 1 is then cocked. This is achieved by gripping the handle 4 in one hand and pulling the knob 20 back with the other hand. With knob 20 fully retracted, the locking member 36 is urged upwards by its spring, so that the protrusion 44 extends into the plunger bore 16 between the portions. 26, 28 of relatively large diameter. When the knob 20 is released, it travels a short distance until the portion 26 abuts the protrusion 44. The driving end 24 is then withdrawn into the plunger bore 16, although a small part of it may still protrude.

The blister 132 is then gripped firmly in one hand and the instrument 1 manipulated to engage the second jaw 58 with the clasp holder 100. With the clasp holder 100 firmly engaged, it is removed from the blister 132.

The blister 132 is then firmly gripped so that the stud holders 70 cannot move, and the instrument 1 is inverted so that the first jaw 8 faces downwards. The first jaw 8 is then engaged with the slot 92 of one stud holder 70. With the jaw 8 firmly engaged, the grip on the blister is released, so that that stud holder 70 can be removed. The instrument 1 is then ready for use.

The instrument 1 is brought up against a person's earlobe 200, with the earlobe 200 located between the stud and clasp holders 70, 100. Note that, at this time, the jaws 8, 58 are a relatively long distance apart. Consequently, the second jaw 58 may well contact or brush against the side of the person's head. The dimension of the clasp holder 100 correspond to those of the second jaw 58, so that no inner or outer face of the jaw 58 is exposed. Consequently, only the clasp holder 100, or one of the clasps held within it, will contact the person. As these are sterile and particular to that person, there should be little or no risk of infection.

The operating lever or position guide 64 is then slowly squeezed towards the handle 4, whilst maintaining the instrument aligned. Most of this movement brings the jaws 8, 58 towards one another, so as to locate the earlobe between them. At the end of the movement, the inner end part 52 of the arm 50 engages the locking member 36 and urges it downwards. The protrusion 44 then releases the plunger 18, so that its plunger spring 16 drives it towards the second jaw 58. The driving end 24 enters the stud holder 70 through the small opening 78, and displaces the stud 120 axially towards the clasp 126. The part circular recess 60 accommodates the pointed end of the stud 120 after it engages the clasp 126. At this time the edge of the member 94 abuts the concave edge 116 of the clasp holder 100.

The operating lever 64 is then released, and the spring 56 urges the jaws 8, 58 apart. The instrument 1 is then carefully pulled straight downwards, ensuring no further contact with the person.

The clasp holder 100 is then gripped on its side walls, taking care not to touch the remaining clasp 126 in it. It is lifted upwards off the second jaw 58 and both inverted and rotated about a vertical axis. It is then carefully inserted back onto the second jaw 58, so as to locate the other clasp 126 facing the first jaw 8.

The first stud holder 70 can be dispensed with, and the second stud holder 70 is engaged on the first jaw 8 in the manner described above. The second ear can then be pierced as for the first ear, following which the second stud holder 70 and the clasp holder 100 can be disposed of.

The holders 70, 100 further prevent any blood from the person readily contaminating the instrument. This should further aid sterile operation.

I claim:

1. An ear piercing apparatus comprising: an instrument which comprises a body including a handle, a first, fixed jaw on the body, an arm movably mounted in the body and extending in alignment with the first jaw, a second jaw secured to the arm, a plunger slideably mounted in the body and aligned with the first and second jaws and actuating means mounted on the body for engaging and driving the plunger towards the second jaw; a disposable stud holder and a stud mounted within the stud holder, with the stud holder mounted on the first jaw; a disposable clasp holder and a clasp mounted in the clasp holder, with the clasp holder mounted on the second jaw; and a protective cover member integral with one of the stud holder and the clasp holder and extending between the first and second jaws and covering a portion of the arm, whereby, in use, a person's earlobe only contacts the clasp and stud holders and the protective cover member.

2. An ear piercing as claimed in claim 1, wherein the stud holder comprises a main part mounted on the first jaw, which main part includes a bore in which the stud is mounted.

3. An ear piercing apparatus as claimed in claim 2, wherein the bore comprises a main portion of relatively large diameter, and a rear opening of smaller diameter, through which the plunger enters.

4. An ear piercing apparatus as claimed in claim 3, wherein the main part of the stud holder has planar front and side walls, and includes at least one transverse flange extending between the side walls and defining a slot, and wherein the first jaw of the instrument includes a rectangular projection received in that slot and a planar top surface on which the stud holder is mounted.

5. An ear piercing apparatus as claimed in claim 4, which includes a generally solid semi-circular top part, in which the bore is provided.

6. An ear piercing apparatus as claimed in claim 5, which includes a semi-circular recess in the top of the main part, which extends as a continuation of the bore.

7. An ear piercing apparatus as claimed in claim 1, 2 or 4, wherein the protective cover member is integral with the stud holder and extends forwardly, covering a portion of the arm adjacent the front jaw.

8. An ear piercing apparatus as claimed in claim 3, in which the clasp holder includes a portion covering the front of the second jaw, to avoid direct contact of the second jaw with a person.

9. An ear piercing apparatus as claimed in claim 8, wherein the clasp holder comprises a central wall, and two end walls disposed on either side of the central wall, with the end walls extending from opposite ends of the central wall and each covering a part of a respective side of the central wall, and with each end wall being configured to retain one clasp.

10. An ear piercing apparatus as claimed in claim 9, wherein the second jaw extends upwardly, and a slot is defined between each end wall and the central wall, each slot opening towards the end of the central wall opposite the end from which the respective end wall extends.

11. An ear piercing apparatus as claimed in claim 10, wherein the ends of the clasp holder have a profile corresponding to the profile of the second jaw where it meets the arm, and each end wall includes a free edge, opposite the end of the central wall from which that end wall extends, having a profile corresponding to the profile of the arm.

12. An ear piercing apparatus as claimed in claim 11, wherein the clasp holder has generally parallel sides and circular ends, and the edges of the end walls are concave, semi-circular edges, and wherein the arm has a generally circular cross-section, and the profile of the lower end of the second jaw corresponds to that of the arm.

13. An ear piercing apparatus as claimed in claim 11, wherein the main part of the stud holder has planar front and side walls, and includes at least one transverse flange defining a slot, and wherein the front jaw of the instrument includes a rectangular projection received in that slot and a planar top surface on which the stud holder is mounted.

14. An ear piercing apparatus as claimed in claim 9, 11 or 13, wherein the protective cover member is integral with the stud holder and extends forwardly covering a portion of the arm adjacent the first jaw.

15. An ear piercing apparatus as claimed in claim 9, 11 or 13, wherein the protective cover member is integral with the clasp holder and extends rearwardly from the second jaw covering a portion of the arm adjacent the second jaw.

16. An assembly for use with an ear piercing apparatus comprising: an instrument which comprises a body including a handle, a first, fixed jaw on the body, an arm movably mounted in the body and extending in alignment with the first jaw, a second jaw secured to the arm, a plunger slideably mounted in the body and aligned with the first and second jaws and actuating means mounted on the body for engaging and driving the plunger towards the second jaw; the assembly comprising: a pair of disposable stud holders each of which includes means for mounting the stud holder on the first jaw of such an instrument; a pair of studs, each mounted in a respective stud holder; a disposable clasp holder means including means for mounting the clasp holder means on the second jaw; a pair of clasps mounted in the clasp holder means; and a pair of protective cover members, each being integral with one of the respective stud holder and the respective clasp holder, for covering a portion of the arm, whereby in use, a person's ear lobe only contacts a disposable stud holder and disposable clasp holder and the corresponding protective cover member.

17. An assembly as claimed in claim 16, wherein each stud holder comprises a main part for mounting on the first jaw, which main part includes a bore in which the respective stud is mounted.

18. An assembly as claimed in claim 17, wherein the bore of each stud holder comprises a main portion of relatively large diameter, and a rear opening of smaller diameter, through which the plunger enters.

19. An assembly as claimed in claim 18, wherein the main part of each stud holder comprises planar front and side walls, at least one transverse flange extending between the side walls and defining a slot, for engaging a rectangular projection of the first jaw, and a rounded top part in which the bore is provided.

20. An assembly as claimed in claim 19, wherein each stud holder includes a semi-circular recess in the top of the main part, which extends as a continuation of the bore.

21. An assembly as claimed in claim 21, in which the clasp holder includes a portion covering the front of the second jaw, to avoid direct contact of the second jaw with a person.

22. An assembly as claimed in claim 21, wherein the clasp holder comprises a central wall, and two end walls disposed on either side of the central wall, with the end walls extending from opposite ends of the central wall and each covering a part of a respective side of the central wall, and with each end wall being configured to retain one clasp.

23. An assembly as claimed in claim 22, wherein a slot is defined between each end wall and the central wall, each slot opening towards the end of the central wall opposite the end from which the respective end wall extends.

24. An assembly as claimed as claim 23, wherein each end wall includes an opening for receiving a clasp with legs, and rectangular protrusions extending towards one another within the opening, for engagement with the legs of the clasp.

25. An assembly as claimed in claim 16, 21 or 24, wherein the protective cover members are integral with respective stud holders.

26. An assembly as claimed in claim 22, 23 or 24, wherein the protective cover members are integral with respective end walls of the clasp holder and extend outwardly therefrom.

* * * * *